US009335711B2

(12) United States Patent
Okuno et al.

(10) Patent No.: US 9,335,711 B2
(45) Date of Patent: May 10, 2016

(54) FITTING STRUCTURE FOR A PLATE-FORM MEMBER

(71) Applicant: Konica Minolta Inc., Chiyoda-ku (JP)

(72) Inventors: Yuusuke Okuno, Kyoto (JP); Yasuyuki Inada, Toyohashi (JP); Kazuki Kobori, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/060,908

(22) Filed: Oct. 23, 2013

(65) Prior Publication Data

US 2014/0119781 A1 May 1, 2014

(30) Foreign Application Priority Data

Oct. 29, 2012 (JP) ..... 2012-237360

(51) Int. Cl.
*G03G 15/08* (2006.01)
*G03G 21/00* (2006.01)

(52) U.S. Cl.
CPC ..... *G03G 21/0029* (2013.01); *G03G 15/0812* (2013.01)

(58) Field of Classification Search
CPC ..... G03G 21/0029; G03G 21/0812
USPC ..... 399/284, 351
See application file for complete search history.

(56) References Cited

U.S. PATENT DOCUMENTS 3,866,266 A * 2/1975 Dunlap ..... 15/256.51
4,895,071 A * 1/1990 Benton ..... 101/169
5,091,753 A * 2/1992 Slapelis ..... 399/349
5,209,164 A * 5/1993 Durrnagel et al. ..... 101/425
6,131,011 A * 10/2000 Kojima et al. ..... 399/351
6,298,203 B1 10/2001 Hashimoto et al.

FOREIGN PATENT DOCUMENTS

JP 55-117175 A 9/1980
JP 7-181802 A 7/1995
JP 2000-075643 A 3/2000
JP 2001-100517 A 4/2001
JP 2003-140461 A 5/2003
JP 2006-349817 A 12/2006

OTHER PUBLICATIONS

Office Action (Notification of Reasons for Refusal) issued on Nov. 19, 2014, by the Japanese Patent Office in corresponding Japanese Patent Application No. 2012-237360 and an English translation of the Office Action. (11 pages).

* cited by examiner

*Primary Examiner* — Billy Lactaoen
(74) *Attorney, Agent, or Firm* — Buchanan Ingersoll & Rooney PC

(57) ABSTRACT

A fitting structure for fitting a plate-form member to a fitting destination member such that a position of the plate-form member relative to a target member is adjustable, the fitting structure has an adjustment pin inserted, in a fashion movable in a position adjustment direction, in an adjustment hole formed in the plate-form member; and a screw member for fastening the plate-form member to the fitting destination member, wherein a direction of a force of the screw member that acts upon the plate-form member when the screw member is in a position where the screw member fastens the plate-form member points from a side where a gap formed between the adjustment pin and the adjustment hole is smaller to a side where the gap is larger.

9 Claims, 6 Drawing Sheets

FITTING STRUCTURE FOR A PLATE-FORM MEMBER

BACKGROUND OF THE INVENTION

1. Field of the Invention

The present invention relates to a fitting structure for fastening a doctor blade provided in a developing device to regulate the amount of developer, a cleaning blade provided in a cleaning device, or the like in an image forming apparatus such as a facsimile machine, a printer, a copier, or the like, to the body of the apparatus.

2. Description of Related Art

In recent years, there have been very strong demands for higher image quality in image forming apparatuses. On the other hand, demands for lower costs have also been increasing. Thus, methods for reducing initial costs while maintaining high image quality have been sought. As one solution, attention has been paid to techniques for easy and accurate gap/contact width adjustment and fitting of a doctor blade in a developing device and of a cleaning blade in a cleaning device.

Ideally, such adjustment should best be dispensed with (adjustment-free); however, in adjustment of a dimension directly related to improvement of image quality, higher dimensional accuracy is demanded than common dimensional tolerances. For example, the gap of a doctor blade in a developing device has to be within a tolerance range as small as about ±0.05 mm to ±0.1 mm; otherwise, uneven density, fogginess, or carrier deposition may result.

The dimensions of, and the fitting accuracy of, a plate-form member such as a doctor blade or a cleaning blade have variations, and suppressing these variations further within common dimensional tolerances requires corresponding costs. Accordingly, when the plate-form member is fitted to the body of an apparatus, positioning adjustment is performed as one conceivable way of achieving tighter dimensional tolerances while suppressing increases in costs.

For example, Patent Document 1 (Japanese Patent Publication No. H07-181802) discloses a doctor gap adjustment mechanism which allows accurate automatic adjustment of the gap (doctor gap) between a developing roller and a doctor blade. Here, after temporary positioning is performed by use of temporary positioning pins, the doctor blade is offset by a predetermined amount by use of adjustment pins, and is thereby positioned.

On the other hand, according to Patent Document 2 (Japanese Patent Publication No. 2001-100517), a support portion is provided in a developing container, and when a doctor blade is fastened to the developing container, a backup member is brought into contact with the support portion to prevent deformation of the developing container. Patent Document 2 thus discloses a method of accurately positioning and fastening a doctor blade even when the doctor blade or another component has a manufacturing variation. Moreover, according to Patent Document 2, the edge position of the doctor blade is detected with a camera. Thus, even when the doctor blade sags in its thickness direction and thus has a variation, it is possible to suppress a variation due to screw tightening and achieve easy and accurate positioning. It is also possible to simplify the inspection process.

However, with the technology disclosed in Patent Document 1, the actual value of the doctor gap after adjustment is unknown, and therefore it needs to be checked in an inspection process as conventionally practiced. With the technology disclosed in Patent Document 2, consideration is given to the pressing force of a screw driver during screw tightening, but no consideration is given to the tightening torque that acts upon the doctor blade during screw tightening. Moreover, during screw tightening, the doctor blade is fastened with contact pins pressed against it; when the contact pins are pressed against it, the doctor blade may be displaced, or may yield to the screw tightening torque and slide.

SUMMARY OF THE INVENTION

According to one aspect of the present invention, a fitting structure for fitting a plate-form member to a fitting destination member such that the position of the plate-form member relative to a target member is adjustable includes: an adjustment pin that is inserted, in a fashion movable in a position adjustment direction, in an adjustment hole formed in the plate-form member; and a screw member for fastening the plate-form member to the fitting destination member. Here, the direction of the force of the screw member that acts upon the plate-form member when the screw member is in the position where it fastens the plate-form member points from the side where a gap formed between the adjustment pin and the adjustment hole is smaller to the side where the gap is larger.

Preferably, the adjustment hole in the plate-form member has at least one of a circular shape, an elliptic shape, an oval shape, and an elongate shape.

Preferably, the side edge of the plate-form member opposite the target member has a curved shape. Further preferably, the side edge of the plate-form member opposite the target member has a curved shape protruding, in a central part in the longer-side direction, toward the target member.

Preferably, the adjustment hole in the plate-form member comprises three or more adjustment holes formed spaced from one another in the longer-side direction of the plate-form member.

Of the adjustment holes in the plate-form member, the adjustment hole arranged in a central part of the plate-form member in the longer-side direction thereof may have a circular shape and the adjustment holes arranged in both end parts of the plate-form member may have an elongate shape in the longer-side direction.

Preferably, cuts are formed in the plate-form member, in the side edge thereof facing away from the side edge opposite the target member, between every two adjacent ones of the adjustment holes in the longer-side direction of the plate-form member.

Preferably, the cut depth of the cuts is adjusted such that the strength of the fitting destination member (F1), the force that moves the adjustment pin (F2), the internal stress produced in the plate-form member during positioning (F3), and the force that acts in the fitting direction of the plate-form member during fastening (F4) fulfill expression (1) below $$F1, F2>F3>F4 \quad (1)$$

Preferably, the dimension of the cuts in the shorter-side direction of the plate-form member is equal to or less than half the dimension of the plate-form member in the shorter-side direction thereof.

DETAILED DESCRIPTION OF THE INVENTION

Hereinafter, a structure for fitting a plate-form member according to the present invention will be described with reference to the accompanying drawings. It should however be understood that the present invention is in no way limited by any embodiment described below.

Preferred Embodiments

Figure 1:
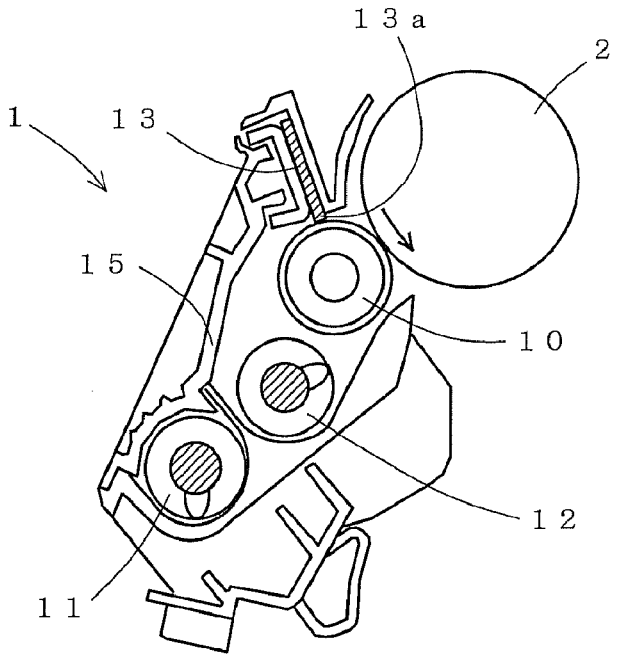
FIG. 1 is an outline sectional view of a developing device embodying the present invention.
Figure 2:
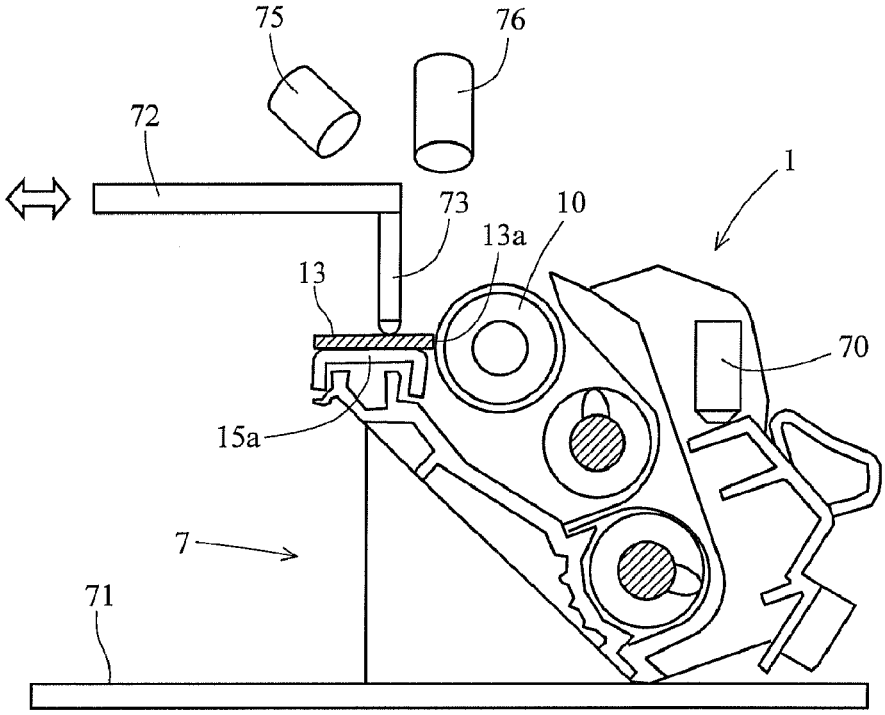
FIG. 2 is an outline sectional view showing a developing device set on an automatic adjustment device.

As an example of a plate-form member fitting structure according to the present invention, an automatic adjustment structure for a doctor blade (plate-shape member) 13 as shown in FIGS. 1 and 2, as is used in a developing device 1 of a two-component-system image forming apparatus, will be described below.

(Outline of a Developing Device)

The developing device 1 shown in FIG. 1 includes a developing roller 10, a stirring screw 11, a feeding screw 12, a doctor blade 13, and a housing (fitting destination member) 15. The developing roller 10 is arranged opposite, and apart from, a photoconductor drum 2. Inside the housing 15, developer (two-component developer containing toner and carrier) is accommodated. The stirring screw 11 and the feeding screw 12 are each a screw member that has, formed around a rotation axis, a helical blade that advances in the axial direction, and transport the developer in mutually opposite directions. The feeding screw 12 feeds the developer to the surface of the developing roller 10. The developing roller 10 rotates while carrying the developer on its surface so as to feed, at the developing position opposite the photoconductor drum 2, the toner to an electrostatic latent image on the photoconductor drum 2, thereby developing the electrostatic latent image.

The doctor blade 13 is a plate-form member in the shape of a strip, and is arranged such that one side edge (regulating surface) 13*a* thereof stays opposite the surface of the developing roller 10 with a predetermined gap in between. Adjusting the gap (doctor gap) between the doctor blade 13 and the developing roller 10 allows adjustment of the amount of developer transported to the developing position.

(Outline of the Doctor Blade Automatic Adjustment Device)

Figure 3:
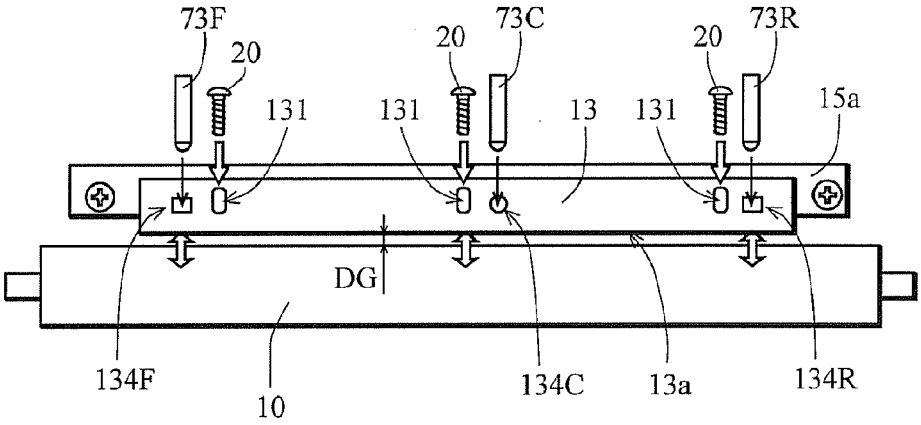
FIG. 3 is an outline diagram showing a relationship between a doctor blade and a developing roller.

FIGS. 2 and 3 are outline diagrams of an automatic adjustment device for a doctor blade (doctor gap automatic adjustment device) 7 used in embodiments of the present invention. FIG. 2 is an outline sectional view showing the developing device 1 set on the automatic adjustment device 7. FIG. 3 is an outline diagram showing the relationship between the doctor blade 13 and the developing roller 10.

With reference to FIGS. 2 and 3, a procedure for automatic adjustment of the doctor blade 13 will be described. First, the developing device 1 is set on the automatic adjustment device 7, and is fastened to a base 71 of the automatic adjustment device 7 with fastening pins 70. At this time, the developing roller 10 is located at the top, and a blade fitting surface 15*a* of the housing 15 lies horizontal.

The doctor blade 13 has through holes 131 formed in it at three places, namely in both end parts and a central part in the longer-side direction thereof. Near the three through holes 131, adjustment holes 134F, 134C, and 134R are respectively formed (in the following description, these are also collectively referred to as "adjustment holes 134").

Above the developing device 1 fastened to the base 71, at positions corresponding to the adjustment holes 134F, 134C, and 134R, three adjustment pins 73F, 73C, and 73R are arranged respectively (in the following description, these are also collectively referred to as "adjustment pins 73") which are fixed to a movable member 72 so as to point downward. The adjustment pins 73F, 73C, and 73R are freely movable, by the action of unillustrated actuators respectively, in the up/down direction and in the adjustment direction (horizontal direction) of the doctor blade 13. The adjustment direction of the doctor blade 13 is a direction in which the regulating surface 13*a* of the doctor blade 13 approaches or recedes from the developing roller 10. Adjusting the doctor blade 13 means positioning the doctor blade 13 such that the doctor gap equals a predetermined value.

Three screws 20 are put through the three through holes 131 in the doctor blade 13, and are screw-engaged with threaded holes (not shown) formed in the blade fitting surface 15*a* so as to be temporarily tightened into the blade fitting surface 15*a* such that the doctor blade 13 is barely movable. In this way, even when the doctor blade 13 has a distortion in the thickness direction thereof, the distortion is corrected by the pressure of the three screws 20. The three through holes 131 are formed in a shape elongate in the shorter-side direction of the doctor blade 13.

Next, with an unillustrated actuator, the movable member 72 is moved, so that the three adjustment pins 73 fit in the corresponding adjustment holes 134 respectively. The adjustment pins 73 have an outer diameter of 2.5 mm, and their tip ends are formed into a tapered shape so as to fit easily into the adjustment holes 134. The adjustment hole 134C at the center is formed in a circular shape, and is given a clearance of about ±15 μm to ±25 μm around the adjustment pins 73. The adjustment holes 134F and 134R in both end parts are given a shape elongate in the longer-side direction of the doctor blade 13, and are given, like the adjustment hole 134C at the center, a clearance of about ±15 μm in the shorter-side direction (the up/down direction in FIG. 2). The aim of giving the adjustment holes 134F and 134R an elongate shape is to prevent, during adjustment performed when the dimensions of the doctor blade 13 have a variation, a situation where lack of margin for deformation of the doctor blade 13 during correction makes the adjustment impossible. The shape of the adjustment holes 134 can be determined appropriately with consideration given to the shape of the tip ends of the adjustment pins 73, the movement direction of the doctor blade 13, etc.; the adjustment holes 134 may have, other than a circular shape and an elongate shape, an elliptic shape, an oval shape, or the like.

Next, while the gap (doctor gap) between the doctor blade 13 and the developing roller 10 is illuminated with a light 75, the gap is monitored with a camera 76 so that, while the doctor gap is measured through image analysis, the position of the doctor blade 13 is adjusted by moving the three adjustment pins 73F, 73C, and 73R with actuators respectively.

After completion of adjustment of the doctor blade 13, the screws 20 at three places are fully tightened with an unillustrated screw driver, so that the doctor blade 13 is fastened to the developing device 1. Lastly, the doctor gap is measured at three spots, and if the results are within a tolerated range, the adjustment is complete. By contrast, if the doctor gap falls outside the tolerated range, the screws 20 are loosened, and the position adjustment is performed once again.

The moving and fastening of the doctor blade 13 during doctor gap adjustment may be achieved other than by use of adjustment pins as described above, for example by pushing the back edge of the doctor blade 13, inserting a member in the gap, or chucking the doctor blade 13. Moving and fastening them by use of adjustment pins, however, is preferable because that is simple and accurate.

(Problems in Automatic Adjustment)

Figure 4:
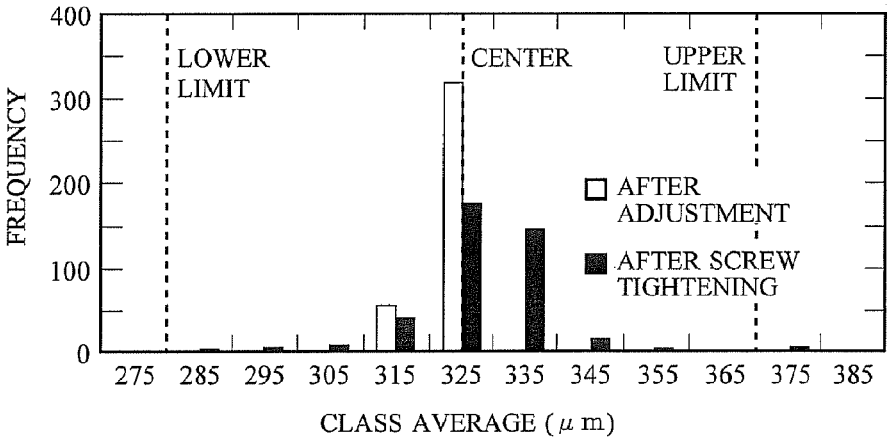
FIG. 4 is a diagram showing variations in doctor gap adjustment on an automatic adjustment device.

Variations in the doctor gap after adjustment and after screw tightening as observed on about 100 units of developing devices adjusted through the above-described procedure by use of the above-described automatic adjustment device 7 are shown in the faun of a histogram in FIG. 4. The nominal value of the doctor gap is 325 μm, and the tolerated range is ±45 μm. As will be understood from FIG. 4, the doctor gap after position adjustment of the doctor blade exhibited a normal distribution about the nominal value, and fell within the tolerated range. Whereas the adjustment conventionally required 60 seconds, automatic adjustment required less, namely 40 seconds. Moreover, the assembly required two-thirds of the conventionally required cost.

However, tightening screws after position adjustment of the doctor blade posed the problem of the doctor blade being displaced, resulting in tenfold variations in the doctor gap. Moreover, the process of position adjustment of the doctor blade by use of the automatic adjustment device scored a yield of about 95%, resulting in defective adjustment in about 5% of the cases. This rate of defects is high compared with the variations in the doctor gap after screw tightening shown in FIG. 4, and this too is a problem.

Through research on these problems, the following two causes have been found out. As for a deviation (unevenness) in the doctor gap during screw tightening, a cause is considered to be the positional relationship between the directions of the torques applied to tighten the screws 20 and the gaps S between the adjustment pins 73 and the adjustment holes 134. That is, as shown in FIG. 5, when the adjustment pins 73 are fitted in the adjustment holes 134 and the adjustment pins 73 are moved to adjust the doctor gap, gaps S of about 15 to 25 μm, that is, as large as the clearance, are produced between the adjustment pins 73 and the adjustment holes 134 on the side opposite to the driving direction of the adjustment pins 73.

In the automatic adjustment device 7, control is performed in the direction in which the doctor gap becomes narrower. Thus, in a case where, as shown in FIG. 5, the regulating surface 13*a* of the doctor blade 13 has high straightness, the adjustment pins 73 cause the doctor blade 13 to move toward the developing roller 10 (downward in FIG. 5). Thus, gaps S are produced on the upper side between the adjustment pins 73 and the adjustment holes 134. In this state, when the screws 20 are tightened and the doctor blade 13 is fastened, during screw tightening, as the screws 20 are rotated, tightening torques act upon the doctor blade 13. The screws 20 are right-hand screws like common screws, and thus the tightening torques have directions as shown in FIG. 5. When a gap S between the adjustment pins 73 and the adjustment holes 134 is so located as to permit the doctor blade 13 to move in the direction of a tightening torque, the doctor blade 13 moves over the distance of the gap S, producing a deviation in the doctor gap.

Figure 5:
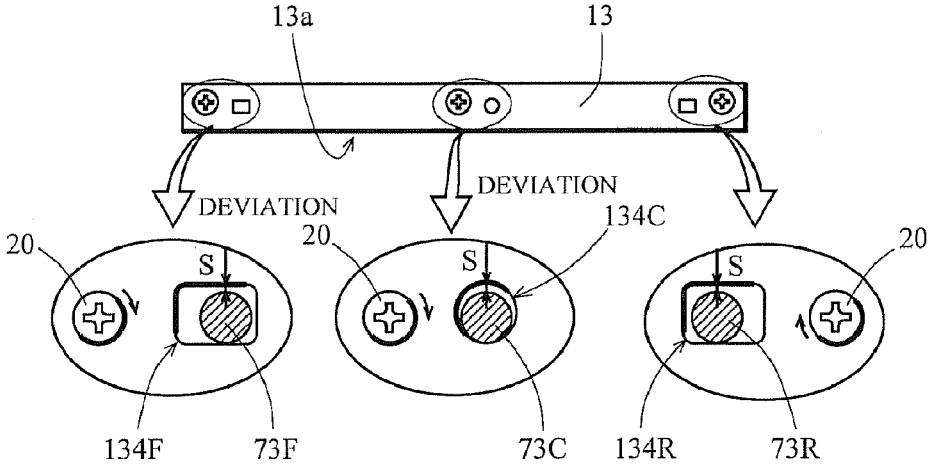
FIG. 5 is a diagram showing a problem in automatic adjustment in a case where a doctor blade has a regulating surface with high straightness.

In the case shown in FIG. 5, deviations are produced in the doctor gap at the position of the adjustment pin 73F at the left and at the position of the adjustment pin 73C at the center. That is, of the through holes 131 (screws 20), those corresponding to the adjustment pins 73F and 73C are located on their left side, but that corresponding to the adjustment pin 73R at the right is located on its right side. Thus, the tightening torques of the screws 20 near the adjustment pins 73F and 73C act from the side where the gaps S are larger to the side where they are smaller (in a case where an adjustment pin 73 is in contact with an adjustment hole 134, there is no gap S), and thus deviations are produced in the doctor gap at the position of the adjustment pin 73F at the left and at the position of the adjustment pin 73C at the center. By contrast, the tightening torque of the screw 20 near the adjustment pin 73R acts from the side where the gap S is smaller to the side where it is larger. Thus, the adjustment pin 73R restricts upward movement of the doctor blade 13, and thereby suppresses a deviation in the doctor gap.

Figure 6:
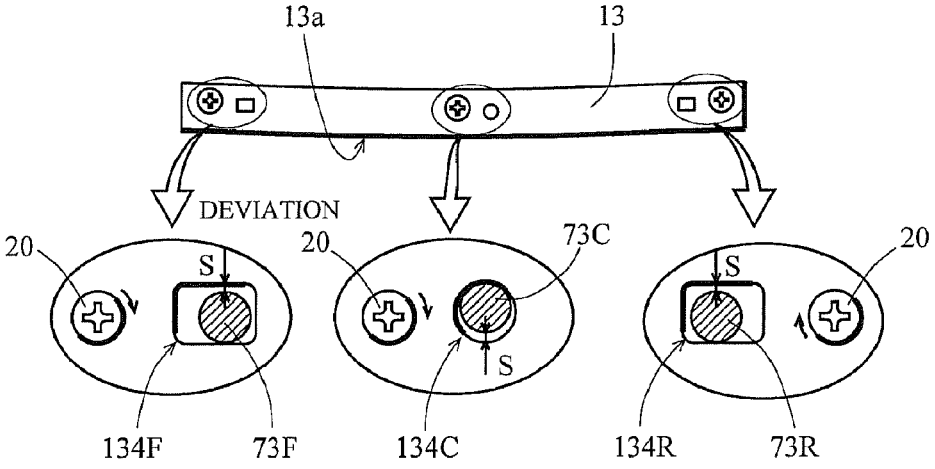
FIG. 6 is a diagram showing a problem in automatic adjustment in a case where a doctor blade has a regulating surface with a convex shape.

FIG. 6 shows a case where the regulating surface 13*a* of the doctor blade 13 is so curved as to be convex toward the developing roller 10 (downward in FIG. 6). The adjustment pins 73F, 73C, and 73R tend to correct the curved shape of the doctor blade 13, and thus, after adjustment, the positions of the adjustment pins 73F, 73C, and 73R within the adjustment holes 134 and the gaps S are as shown in FIG. 6. In this state, when the screws 20 are tightened, the tightening torque of the screw 20 near the adjustment pin 73F at the left acts from the side where the gap S is larger to the side where it is smaller, and a deviation is produced in the doctor gap at the position of the adjustment pin 73F at the left. By contrast, the tightening torques of the screws 20 near the adjustment pin 73C at the center and the adjustment pin 73R at the right act from the side where the gaps S are smaller to the side where they are larger. Thus, the adjustment pin 73C at the center and the adjustment pin 73R at the right restrict downward movement of the doctor blade 13, and thereby suppress a deviation in the doctor gap.

Figure 7:
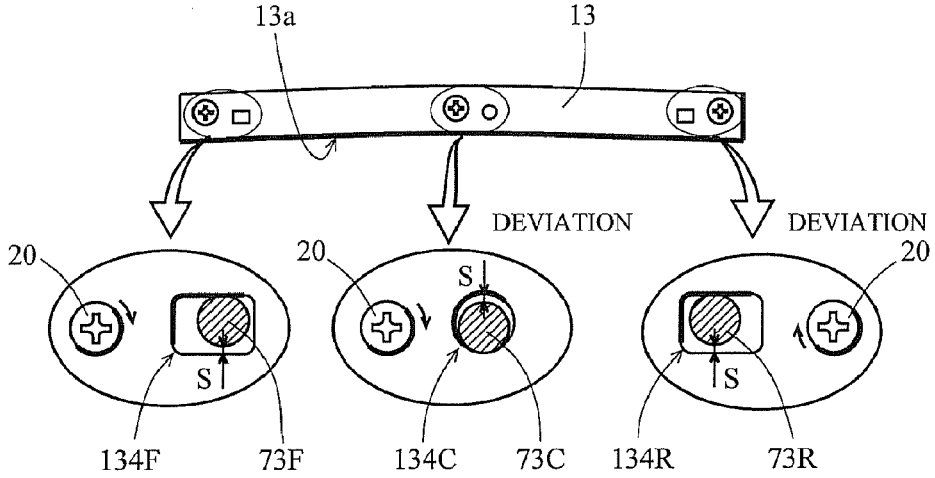
FIG. 7 is a diagram showing a problem in automatic adjustment in a case where a doctor blade has a regulating surface with a concave shape.

FIG. 7 shows a case where the regulating surface 13*a* of the doctor blade 13 is so curved as to be convex away from the developing roller 10 (upward in FIG. 7). The adjustment pins 73F, 73C, and 73R tend to correct the curved shape of the doctor blade 13, and thus, after adjustment, the positions of the adjustment pins 73F, 73C, and 73R within the adjustment holes 134 and the gaps S are as shown in FIG. 7. In this state, when the screws 20 are tightened, the tightening torques of the screws 20 near the adjustment pin 73C at the center and the adjustment pin 73R at the right act from the side where the gaps S are larger to the side where they are smaller, and deviations are produced in the doctor gap at the positions of the adjustment pin 73C at the center and at the adjustment pin 73R at the right. By contrast, the tightening torque of the screw 20 near the adjustment pin 73F at the left acts from the side where the gap S is smaller to the side where it is larger.

Thus, the adjustment pin 73F at the left restricts downward movement of the doctor blade 13, and thereby suppresses a deviation in the doctor gap.

As a second cause, through a close review of data, it has been found that, while the tolerance for the straightness of the regulating surface 13*a* of the doctor blade 13 is ±30 μm, such doctor blades 13 as have straightness close to the limits of the tolerance are liable to end in defective adjustment of the doctor gap.

When a doctor blade 13 with a curved regulating surface 13*a* as shown in FIGS. 6 and 7 is adjusted with the adjustment pins 73, deformation of the doctor blade 13 produces internal stress. The internal stress tends to be the larger the sharper the curvature. As mentioned above, during screw tightening, if the doctor blade 13 is displaced due to a gap S, the internal stress may act like a spring, causing the doctor blade 13 to be displaced greatly from the adjusted position.

Moreover, even when no deviation is produced in the doctor gap during screw tightening, when the adjustment pins 73F, 73C, and 73R are removed out of the adjustment holes 134 after screw tightening, the internal stress in the doctor blade 13 may act as residual stress to produce strain in the housing 15 of the developing device 1, the strain causing a defective doctor gap.

Figure 8:
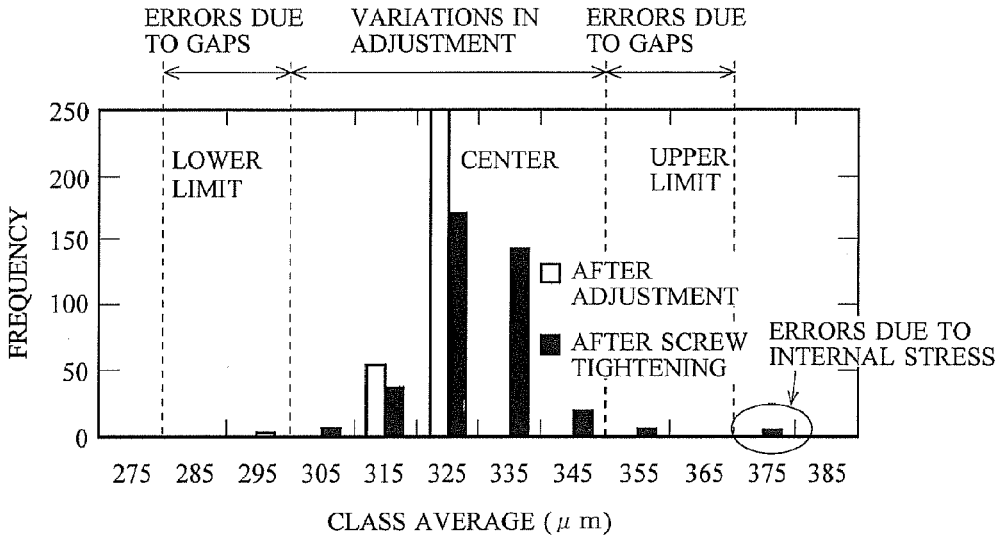
FIG. 8 is a diagram showing variations in doctor gap adjustment from after adjustment of a doctor blade to after screw tightening.

In summary, as shown in FIG. 8, change in the distribution of deviations in the doctor gap from after doctor gap adjustment to after screw tightening is considered to be roughly divided into change ascribable to the gaps S (about ±15 to ±25 μm) and sporadic large change due to internal stress ascribable to curvature in the doctor blade 13.

Accordingly, in the fitting structure according to the present invention, the positions of the adjustment holes 134 in the doctor blade 13 and the positions at which it is fastened with the screw member 20 are located at predetermined positions, and thereby deviations in the doctor gap during screw tightening are suppressed. Embodiments will be presented below.

(Embodiment 1)

Figure 9:
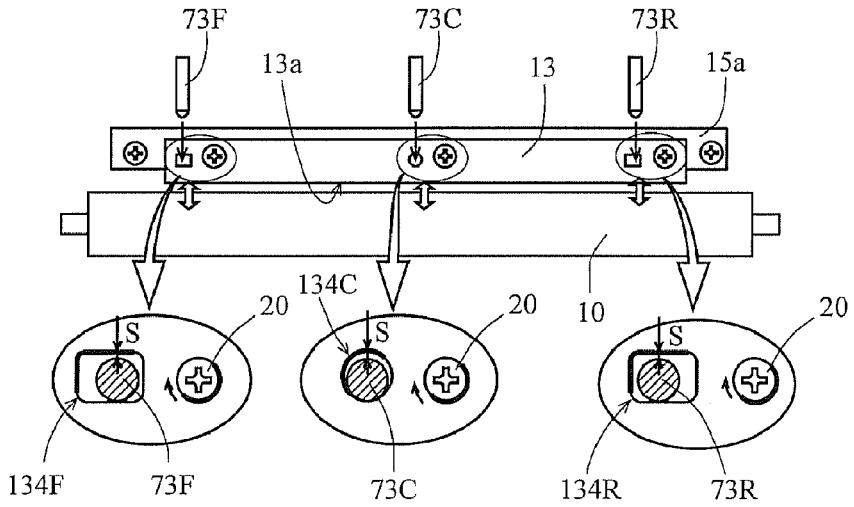
FIG. 9 is an outline diagram showing Embodiment 1, showing a relationship between gaps around adjustment pins after screw tightening and the directions of screw tightening forces.

FIG. 9 is an outline diagram showing the relative position between the adjustment pins 73 and the adjustment holes 134 after screw tightening and the directions of the screw tightening torques. The doctor blade 13 shown in this figure differs from that shown in FIG. 5 in the relative position between the adjustment holes 134F and 134C and the through holes 131 (screws 20) corresponding to the adjustment pins 73F and 73C. Specifically, the three adjustment holes 134 are all located on the left side of the screws 20 respectively. Thus, when the three screws 20 are tightened, the tightening torques that act upon the doctor blade 13 act from the side where the gaps S between the adjustment pins 73 and the adjustment holes 134 are smaller to the side where they are larger. Thus, the adjustment pins 73 restrict downward movement of the doctor blade 13, and thereby suppress a deviation in the doctor gap.

(Embodiment 2)

Figure 10:
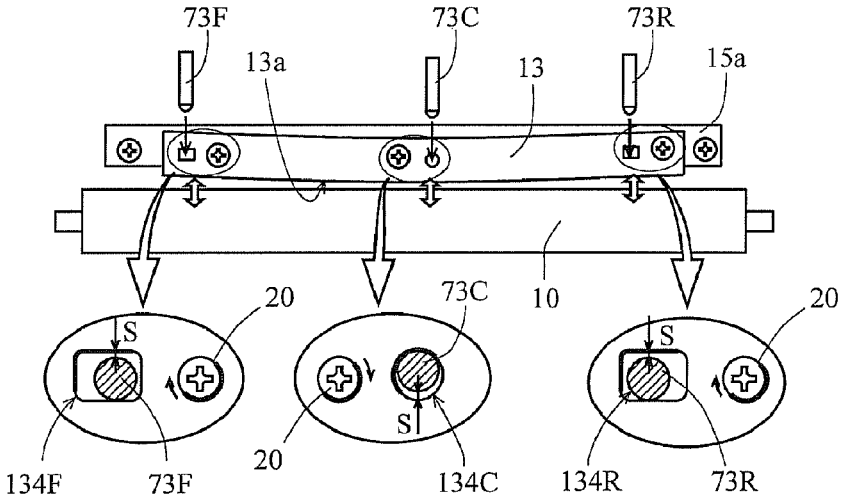
FIG. 10 is an outline diagram showing Embodiment 2, showing a relationship between gaps around adjustment pins after screw tightening and the directions of screw tightening forces.

Like FIG. 9, FIG. 10 is an outline diagram showing the relative position between the adjustment pins 73 and the adjustment holes 134 after screw tightening and the directions of the screw tightening torques. The doctor blade 13 has a manufacturing variation, and its regulating surface 13*a* is often curved, though within a tolerated range. Depending on the direction of the curvature of the doctor blade 13, the gaps S between the adjustment pins 73 and the adjustment holes 134 have varying positions and sizes after adjustment, and this may cause the doctor blade 13 to move during screw tightening, producing a deviation in the doctor gap. Accordingly, as shown in FIG. 10, the doctor blade 13 is so molded that its regulating surface 13*a* has a curved shape protruding toward the developing roller 10 (downward in FIG. 10). Thus, the positional relationship between the adjustment pins 73 and the gaps S in the adjustment holes 134 after doctor gap adjustment is uniquely determined, and this helps reliably prevent a deviation in the doctor gap during screw tightening.

With the so shaped doctor blade 13, the adjustment holes 134F and 134R corresponding to the adjustment pins 73F and 73R are arranged on the left side of the screws 20 in FIG. 10, whereas the adjustment hole 134C corresponding to the adjustment pin 73C is arranged on the right side of the screw 20 in FIG. 10. Thus, the tightening torques that act upon the doctor blade 13 when the three screws 20 are tightened act from the side where the gaps S between the adjustment pins 73 and the adjustment holes 134 are smaller to the side where they are larger. Thus, the adjustment pins 73 restrict downward movement of the doctor blade 13, and thereby suppress a deviation in the doctor gap.

The regulating surface 13*a* of the doctor blade 13 may instead be given a curved shape protruding away from the developing roller 10 (upward in FIG. 10). However, the amount of developer transported by the developing roller 10 tends to be larger in a central part of the doctor blade 13 than in both end parts thereof, and it is therefore preferable to give the regulating surface 13*a* a curved shape protruding toward the developing roller 10 from the viewpoint of stabilizing the amount of developer transported to the developing position. The dimension of the protrusion of the regulating surface 13*a* can be determined appropriately with consideration given to the productivity of the doctor blade 13 etc., and is typically about 20 μm.

(Embodiment 3)

Figure 11:
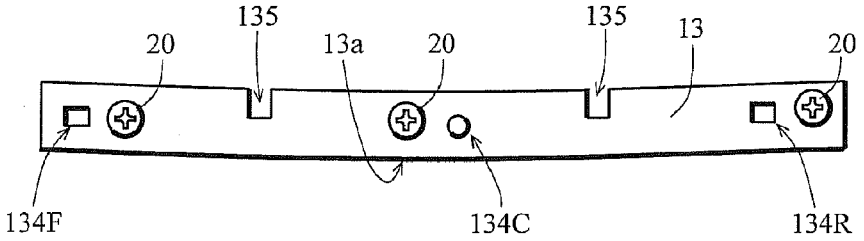
FIG. 11 is a plan view showing another example of a doctor blade.

FIG. 11 is a plan view showing another example of the doctor blade 13 whose regulating surface 13*a* has a curved shape protruding toward the developing roller 10 (downward in FIG. 11). When the doctor blade 13 is given a regulating surface 13*a* having a curved shape protruding toward the developing roller 10, as described above, deformation of the doctor blade 13 during correction produces inner stress and residual stress. Accordingly, in the doctor blade 13 shown in FIG. 11, in the side edge thereof opposite from the regulating surface 13*a*, between every two adjacent adjustment holes 134 in the longer-side direction of the doctor blade 13, cuts 135 are provided. This allows easier deformation of the doctor blade 13, and helps release internal stress.

Stress concentrates at the cuts 135, and therefore the cuts 135 are preferably given a shape having a substantially straight base with rounded corners at both ends of the base so that stress is distributed substantially evenly within the cuts 135 to suppress destruction resulting from concentration of stress.

Moreover, it is preferable to adjust the cut depth such that expression (1) noted earlier is fulfilled with respect to the housing strength (F1), the force that moves the adjustment pins (F2), the internal stress (F3), and the force that acts upon the doctor blade during fastening (screw tightening). The reason is as follows: if the internal stress in the doctor blade 13 is greater than the force of the actuators that move the adjustment pins 73F, 73C, and 73R, then doctor gap adjustment itself is impossible, posing a problem; to prevent a slight deviation resulting from an error factor such as vibration during screw tightening, however, it is preferable that moderate internal stress be acting upon the three adjustment pins 73.

The internal stress in the doctor blade 13 can be adjusted by adjusting the cut depth of the cuts 135, and the larger the cut depth, the smaller the internal stress. However, if the cut depth exceeds half the dimension of the doctor blade 13 in its shorter-side direction, it may affect the magnetism restricting ability of the doctor blade 13. Thus, it is preferable that the cut depth be equal to or less than half the dimension of the doctor blade 13 in its shorter-side direction. The internal stress in the doctor blade 13 may be adjusted by adjusting the width or number of cuts 135. Typically, the doctor blade 13 is given a thickness of about 1.6 mm and a width of about 14 mm, the cut depth is about 7 mm, and the cuts 135 are given a width of about 5 mm.

(Examples)

By use of the automatic adjustment device 7 shown in FIGS. 1 and 2, the doctor blade shown in FIG. 11 was fastened, by tightening of screws, to about 100 units of developing devices. Then, the doctor gap was measured after adjustment and after screw tightening. The results are shown in the form of a histogram in FIG. 12.

Figure 12:
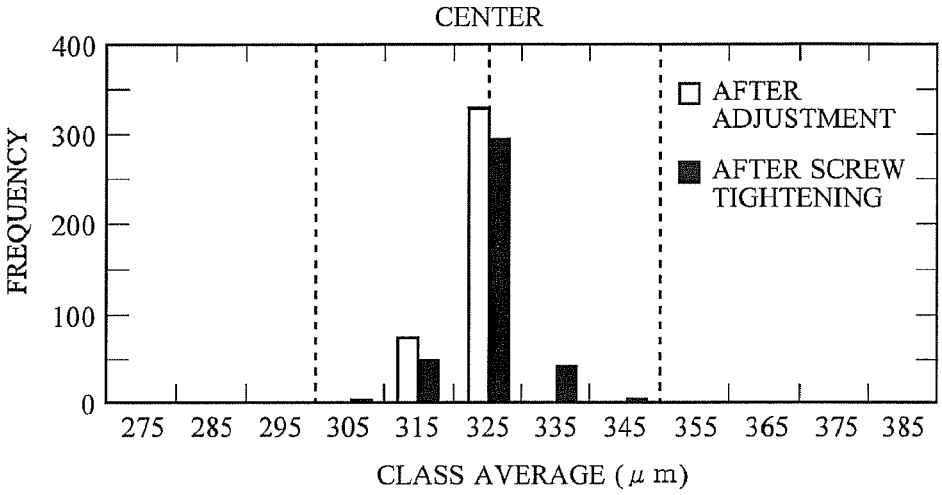
FIG. 12 is a diagram showing variations in doctor gap adjustment from after adjustment of a doctor blade to after screw tightening, as observed when the doctor blade shown in FIG. 11 is automatically adjusted.

As will be clear from FIG. 12, variations in the doctor gap after screw tightening were within about ±25 μm, approximately half the conventionally observed range. No defective adjustment due to a displacement of the doctor blade 13 was observed.

In the embodiments described above, the positioning of the doctor blade 13 on the developing device 1 is achieved through automatic adjustment; needless to say, it may instead be achieved through manual adjustment. Although the above description takes a doctor blade as a plate-form member, the present invention is also applicable to the fitting of, for example, cleaning blades used in cleaning devices to remove developer.

According to the present invention, a screw member is arranged such that the force that the screw member exerts on a plate-form member in a position adjustment direction points from the side where the gap formed between an adjustment pin and an adjustment hole is smaller to the side where the gap is larger. It is thus possible to suppress displacement of the plate-form member caused by the screw member, to reduce adjustment variations of the plate-form member, and to reduce manufacturing cost.

What is claimed is:

1. A fitting structure for fitting a plate-form member to a fitting destination member such that a position of the plate-form member relative to a target member is adjustable, the fitting structure comprising:

a plurality of adjustment pins, each inserted, in a fashion movable in a position adjustment direction, in a respective one of a plurality of adjustment holes formed in the plate-form member; and a plurality of screw members for fastening the plate-form member to the fitting destination member, wherein the plurality of adjustment pins and the plurality of screw members are horizontally arrayed relative to one another along a longer-side direction of the plate-form member, and wherein a direction of a force of each of the plurality of screw members that acts upon the plate-form member at a location of the respective one of the plurality of adjustment holes, when each of the plurality of screw members is in a position where each of the plurality of screw members fastens the plate-form member, points from a side where a gap formed between a respective one of the plurality of adjustment pins and the respective one of the plurality of adjustment holes is smaller, to a side where the gap is larger.

2. The fitting structure according to claim 1, wherein each of the plurality of adjustment holes in the plate-form member has at least one of a circular shape, an elliptic shape, an oval shape, and an elongate shape.

3. The fitting structure according to claim 1, wherein a side edge of the plate-form member that opposes the target member has a curved shape.

4. The fitting structure according to claim 3, wherein the side edge of the plate-form member that opposes the target member has a curved shape protruding, in a central part in the longer-side direction, toward the target member.

5. The fitting structure according to claim 1, wherein the plurality of adjustment holes in the plate-form member comprises three or more adjustment holes formed spaced from one another in the longer-side direction of the plate-form member.

6. The fitting structure according to claim 5, wherein, of the adjustment holes in the plate-form member, an adjustment hole arranged in a central part of the plate-form member in the longer-side direction thereof has a circular shape and the adjustment holes arranged in both end parts of the plate-form member have an elongate shape in the longer-side direction.

7. The fitting structure according to claim 5, wherein cuts are formed in the plate-form member, in a side edge thereof facing away from the side edge that opposes the target member, between every two adjacent ones of the adjustment holes in the longer-side direction of the plate-form member.

8. The fitting structure according to claim 7, wherein a cut depth of the cuts is adjusted such that a strength of the fitting destination member (F1), a force that moves at least one of the plurality of adjustment pins (F2), an internal stress produced in the plate-form member during positioning (F3), and a force that acts in a fitting direction of the plate-form member during fastening (F4) fulfill expression (1) below $$F1, F2>F3>F4 \quad (1).$$

9. The fitting structure according to claim 7, wherein a dimension of the cuts in a shorter-side direction of the plate-form member is equal to or less than half a dimension of the plate-form member in the shorter-side direction thereof.

* * * * *